United States Patent [19]

Retzsch

[11] 4,018,559

[45] Apr. 19, 1977

[54] NON-REWET LEATHER AND METHOD OF PRODUCING SAME

[75] Inventor: Clinton E. Retzsch, Morris Township, N.J.

[73] Assignee: Diamond Shamrock Corporation, Cleveland, Ohio

[22] Filed: May 5, 1975

[21] Appl. No.: 574,634

Related U.S. Application Data

[63] Continuation-in-part of Ser. No. 479,131, June 14, 1974, abandoned.

[52] U.S. Cl. ..... 8/94.2; 8/94.1 D; 8/94.1 P; 8/94.24

[51] Int. Cl.[2] ..... C14C 5/00; C14C 3/18

[58] Field of Search ..... 8/94.2, 94.24, 94.1 D, 8/94.1 P

[56] References Cited

UNITED STATES PATENTS

| | | | |
|---|---|---|---|
| 2,059,570 | 11/1936 | Fiske et al. | 210/23 |
| 2,067,628 | 1/1937 | Fiske et al. | 210/23 |
| 2,454,542 | 11/1948 | Bock et al. | 260/49 |
| 2,454,543 | 11/1948 | Bock et al. | 260/49 |
| 2,705,704 | 4/1955 | Sorenson | 260/51 |
| 2,894,931 | 7/1959 | Somerville et al. | 260/53 UX |
| 3,127,373 | 3/1964 | Guttag | 260/53 X |
| 3,409,571 | 11/1968 | Shepard et al. | 260/59 X |
| 3,414,366 | 12/1968 | Nordstrom et al. | 8/12 |
| 3,524,760 | 8/1970 | Pinkerton | 117/63 |
| 3,934,975 | 1/1976 | Kelly et al. | 8/94.24 |

*Primary Examiner*—J.L. Schofer
*Assistant Examiner*—A. L. Clingman
*Attorney, Agent, or Firm*—John C. Tiernan

[57] ABSTRACT

The present invention relates to the treatment of leather and more particularly to a novel non-rewet dry cleanable leather, and the treatment method by which it is produced. The water-resistance property of a leather which has been treated with a polymeric phosphate ester syntan is significantly improved by subsequently subjecting such a treated leather to a non-aqueous solvent extraction procedure.

8 Claims, No Drawings

NON-REWET LEATHER AND METHOD OF PRODUCING SAME

CROSS REFERENCE TO RELATED APPLICATION

This application is a continuation-in-part of copending application Ser. No. 479,131 filed June 14, 1974 now abandoned, the specification and claims of which are specifically incorporated herein by reference.

The present invention is more particularly directed to an improvement in the method wherein leather is treated with materials such as a non-rewetting syntan, and a non-rewetting fatliquor (each of said treatments being followed by treatments with basic chromium sulfate and a chrome complex) to produce a non-rewet dry cleanable leather. The improved process of the present invention comprises the additional step of subjecting the resultant leather to a solvent extraction, thereby producing a final treated leather with from 25 to over 100% improvement in water resistance (as measured by the Maeser Flex Test).

BACKGROUND OF THE INVENTION

There has of course long been a significant interest in developing improved water-proof or non-rewet leathers and/or better treatment methods for producing such leathers. In particular there has been an increasing desire to develop an aqueous system for producing a non-rewet leather. While there are a number of problems which have been encountered in trying to develop such an aqueous system, the most common and perhaps the most obvious is the inherent re-wetting nature of the normal syntans and fatliquors employed in the basic treatment of the leather.

In general, syntans, retans and fatliquors have a very definite hydrophilic nature, and in the quantities employed to produce satisfactory leather this hydrophilic character is imparted to the leather itself. In order to obtain leather with the desired non-rewet characteristics, it was heretofore necessary to employ overly large amounts of water repellent chemicals.

More recently, an improved aqueous system was disclosed by Kelly and Papalos in the U.S. application Ser. No. 405,113 filed Oct. 10, 1973, now U.S. Pat. No. 3,934,975, issued Jan. 27, 1976, the specification and claims of which are incorporated herein by reference. Kelly and Papalos disclose the use of an alkylphenol-polyphenol condensate which has been alkoxylated and phosphated as the syntan. The treatement disclosed by Kelly and Papalos produced a leather having a water resistance comparable to that obtained using the most effective systems previously available, while producing a leather which was considerably superior to those produced from such previously available systems on a dry evaluation basis, and on an overall basis.

SUMMARY OF THE INVENTION

In general, it is well known to treat leathers with syntans, retans and fatliquors, each of which is generally separately set by a treatment with a chrome complex material and a basic chromium sulfate. I have now found that greatly improved water resistance can be obtained by the use of a solvent treatment step subsequent to the application and final setting of the syntan, fatliquor, etc. I have found that this solvent treatment need not be performed subsequent to the final washing and drying step of the procedure heretofore employed, but can effectively be carried out immediately following the final treatment with the chrome complex material thereby making it possible to eliminate a separate washing and drying step.

PREFERRED EMBODIMENTS

In the preferred embodiment of the present invention, the leather is one which has been treated with a non-rewet syntan such as one of the type disclosed and claimed by Kelly and Papalos, an alkylphenol-polyphenol condensate which has been alkoxylated and phosphated. The leather produced according to the preferred embodiment of the present invention exhibits not only an unexpectedly large increase in water resistance, but also a higher degree of bound oil. Still more surprising, the higher bound oil content is exhibited not only in the surface layers but throughout the leather, a property long sought but heretofore not generally obtainable in non-rewet drycleanalbe leathers.

In the past, it has been speculated that in using an aqueous system which employs a non-rewetting syntan (such as a polymeric phosphate ester), during normal processing the non-rewetting syntan combines with the chrome complex, and fills the voids between the fibers of the leather. It is then rendered non-hydrophilic by the addition of basic chromium sulfate, and the leather is then washed to remove any unreacted chromium sulfate. A generally similar mechanism is postulated as applicable to the fatliquoring operation. The fatliquor, usually a system containing a surfactant such as an amine neutralized fatty alcohols phosphate, which acts as an emulsifier for the system, and has the ability to combine with the chrome complex already layed down on the leather fibers. In normal processing the fatliquor is also treated with the basic chromium sulfate to render the material found in the voids between the fibers non-hydrophilic in nature. Finally, the leather is treated with a conventional water-repellant treatment material such as a fluorocarbon material, a silicone, or a chrome stearato complex.

It is not my intention to be bound by any single theory by which the highly unexpected degree of water resistance of leathers produced according to my invention might be explained. It is, however, possible to postulate an explanation wholly consistent with the generally accepted prior theories summarized above. Thus, it would appear that in the solvent extraction step of my invention, the non-hydrophilic materials deposited in the voids or interstices between the fibers are somehow more uniformly and effectively distributed at least throughout all of the voids and interstices between the leather fibers on or near the surface, and probably throughout all of the interconnected voids and interstices throughout the entire cross section of the treated leather.

More complete, more effective, and more uniform filling of the voids betweeen the fibers at the surfaces of the leather would certainly be consistent with the vastly improved water resistance observed in the novel leathers of the present invention. The highly unexpected improvement in bound oil would also be wholly consistent with such a theory, but it might also suggest that the solvent extraction treatment may have an even greater effect, and that it actually results in more complete and more uniform filling of all of the voids and interstices throughout the entire cross sectional area of the treated leather. In fact, as will be seen hereinafter, it can be argued that the solvent extraction results in a more uniform distribution of the bound oil througout the entire treated leather.

As previously noted, the present invention has application with a wide variety of treated chrome tanned leathers, though the preferred leathers are those which have been treated with a syntan within the scope of those disclosed and claimed in the above noted application of Kelly and Papalos. With regard to other materials which are employed in the basic treatment steps there are a wide variety of materials known to those skilled in the art which may be employed such as non-rewet fatliquors, chrome materials and the like. In general, while all these materials may not give the exact same degree of improvement, they do not appear to substantially alter the results obtained in the practice of the present invention, particularly where the non-rewet syntan is one which falls within the preferred embodiment.

A wide variety of solvents may also be employed in the solvent extraction treatment required by the present invention. By way of illustration and not by way of limitation, the following specific solvents are examples of materials which have been found to be useful in the practice of the present invention:

| | | |
|---|---|---|
| Chloroform | Ethyl alcohol | Methyl Ethyl Ketone |
| Perchloroethylene | Ethyl ether | Stoddard Solvent |
| n-hexane | Acetone | Petroleum ether |

In the experiments to be described in more detail hereinafter, except as otherwise noted, Blue split and shaved stock having a split weight of 41/2 to 5 oz. was employed. While this material was used in most of the tests for uniformity, and to retain a valid basis for comparison, similar experiments were conducted on other types of of stock such s calfskin, pigskin, sheepskin and the like, and in every case comparably satisfactory results were observed. Again, except as otherwise noted, the following general treatment procedure was employed:

| GENERAL TREATMENT PROCEDURE: | | |
|---|---|---|
| 1. | Wash: | 15 minutes at 90° F. |
| 2. | Float: | 100% Water at 90° F. |
| 3. | Add: | ½% Sodium Bicarbonate |
| 4. | Run: | 20 minutes to pH 4.2 to 4.5 |
| 5. | Wash: | 10 Minutes at 100° F. |
| 6. | Float: | 100% water at 100° F. |
| 7. | Add: | 12 to 15% Non-rewet Syntan[1] - 2 feeds 20/25 min. |
| 8. | Add: | Dye (dissolved at 140° F.) |
| 9. | Run: | 30 minutes |
| 10. | Add: | ½% Formic Acid 2–15 min. feeds - pH 3.6 – 3.8 |
| 11. | Add: | 3 to 5% Basic Chrome Sulfate ($Cr_2O_3$: Basicity: 56–58%) |
| 12. | Run: | 30 minutes |
| 13. | Wash: | 10 minutes at 120° F. |
| 14. | Float: | 100% water at 120° F. |
| 15. | Add: | Non-rewet Fatliquor[2] |
| 16. | Run: | 30 minutes |
| 17. | Add: | 2% Basic Chrome Sulfate |
| 18. | Run: | 20 minutes |
| 19. | Wash: | 10 minutes at 100° F. |
| 20. | Float: | 100% water at 100° F. |
| 21. | Add: | 3 to 5% of a conventional water repellant treatment material[3] |
| 22. | Run: | 30 minutes |

-continued

| GENERAL TREATMENT PROCEDURE: | | |
|---|---|---|
| 23. | Wash: | 5 minutes at 100° F. |

[1]Non-rewet Syntan such as the nonylphenol homologue of the polymeric phosphate ester produced in Example 1 of Kelly and Papalos $H_2O$: 35%, pH: 7.0

[2]A formulated Non-rewet Fatliquor containing an amine neutralized fatty Alcohol Phosphate as an emulsifier for a blend of oils and esters; pH: 7.5

[3]Chrome Stearato Complex such as Chrolon (Diamond Shamrock) or a fluorocarbon chrome complex such as Pentel 52; (Pennwalt Corporation)

At this point one of two alternative procedures were followed. In the first procedure the stock was pulled, horsed to drain overnight, and later solvent treated after drying (using for example the Soxhlet extraction technique of Example 1, and in the second the stock was flooded with an equal weight of Stoddard Solvent and run for 30 minutes, then pulled and horsed to drain. In both cases following overnight horse up, the stock was set out and dried.

A series of tests were conducted to determine the improvement in the water resistance obtained by subjecting the leather to a solvent extraction procedure.

EXAMPLE 1

After the leathers were completely dried, and allowed to stand 24 to 48 hours in order to readjust to normal room conditions, samples were taken for testing on the Maeser Flex Tester. Additional samples were taken adjacent to the original cuttings, and these were extracted in a Soxhlet extractor for 5 hours using n-Hexane as the solvent. They were then air dried for 24 hours and subjeced to Maeser Flex testing. All samples were flexed until the first droplet of water appeared at which point the number of flexes was recorded, and the percent water absorption was determined. Leather which had been given the Stoddard Solvent treatment immediately at the end of the non-rewet system was tested as is without an additional solvent extraction. The results of these tests are set forth in Table I.

TABLE 1

| FLEXES AND WATER ABSORPTION | | | |
|---|---|---|---|
| Type of Leather | Original | Soxhlet Extracted | Stoddard Solvent Treatment |
| Side 1 | 89,000<br>19% | 476,000<br>16% | — |
| Side 2 | 10,500<br>14% | 230,000<br>24% | — |
| Side 3 | 95,800<br>69% | 476,000<br>13% | — |
| Side 4 | 17,900<br>6.5% | — | 219,300<br>12% |
| Commercial Leather* | 2,400<br>8.2% | 400<br>2.9% | — |

*Sample of commercially available treated leather (conventional chrome tanned) currently being sold for direct conversion into "Water-Proof" boots.

During analytical work on some of the leathers it was noted that there was a lower amount of oil extracted from the experimental leathers than would be found in conventional fatliquored leathers. In order to investigate this more thoroughly, a series of tests were conducted as described in Example II.

EXAMPLE II

Swatches of leather were taken adjacent to one another. Swatch A was split into three layers: grain, middle and flesh. The layers were then ground and extracted with n-hexane in the Soxhlet extractors. Following extraction, the ground samples were air dried and then the bound oil was determined by hydrolyzing with 20% potassium hydroxide, acidifying with hydrochloric acid and extracting the hydrolysate with ethyl ether.

Swatch B was first given an extraction with n-hexane. Following this extraction it too was split into three layers and then treated in the same manner as Swatch A. The results are set forth in Table II.

TABLE II

EXTRACTABLE AND BOUND CIL ANALYSIS

| | Sample A | | Sample B | |
|---|---|---|---|---|
| | % Extractable Oil | % Bound Oil | % Extractable Oil | % Bound Oil |
| SIDE I | | | | |
| Grain | 8.20 | 1.58 | 0.89 | 3.84 |
| Middle | 4.03 | 4.56 | 0.59 | 1.69 |
| Flesh | 6.89 | 2.56 | 1.07 | 1.32 |
| SIDE II | | | | |
| Grain | 5.24 | 2.93 | 0.49 | 1.95 |
| Middle | 1.87 | 0.52 | 0.51 | 1.25 |
| Flesh | 5.48 | 3.74 | 0.93 | 2.10 |
| COMMERCIAL LEATHER* | | | | |
| Grain | 23.6 | 4.05 | 2.23 | 3.95 |
| Middle | 9.9 | 1.07 | 1.02 | 0.72 |
| Flesh | 13.3 | 1.09 | 1.10 | 1.80 |

Note: All %'s are on the moisture free basis
Commercial Leather* Same as in Table I These data indicate that there is generally more bound oil than extractable oil in the novel leathers of the present invention ( a "high bound oil ratio"), and it is felt that this may contribute greatly to the improved water resistance. The conventional leather shows the opposite, a generally higher extractable, as opposed to bound oil content, and this "high extractable oil ratio" may contribute to the rapid penetration of water during flexing.

The increased flexes brought about by these solvent treatments naturally raised the question as to what other solvents might be useful. A further series of tests were conducted in which adjacent pieces were extracted with various solvents, (using the second, or Stoddard Solvent treatment procedure) dried and then tested on the Maeser Flex Tester. The results of these tests are set forth on Table III.

TABLE III

EFFECTS OF VARIOUS SOLVENTS ON NON-REWET LEATHER

| Solvent | % Extractables M.F.B. | Maeser Flexes | % Water Absorption |
|---|---|---|---|
| Control | — | 253,000 | 14 |
| n-Hexane | 5.23 | 410,000 | 12 |
| Chloroform | 3.23 | 370,000 | 12 |
| Stoddard Solvent | 7.10 | 600,000 | 12 |
| MEK | 3.90 | 596,000 | 12 |
| Ethyl Alcohol | 4.78 | 300,000 | 15 |
| Petroleum Ether | 4.95 | 515,000 | 14 |
| Ethyl Ether | 3.52 | 400,000 | 14 |
| Acetone | 3.08 | 515,000 | 13 |
| Perchlorethylene | 4.29 | 360,000 | 16 |

It was noted hereinbefore, that a wide variety of materials can be employed in the basic treatment steps without substantially departing from the present invention. Thus, while the specific treating agents listed in the general treatment procedure were employed in all experiments to insure valid comparative results, a wide variety of substituents are obviously available.

Again, as noted, earlier, these various substitute materials do not always produce exactly the same degree of water resistance, but they will provide a leather which will generally exhibit a comparable improvement in water resistance after being subjected to the solvent extraction procedures according to the present invention. That is to say, the difference which might be observed where substitute materials are employed are generally differences of "degree",as compared to the difference in "kind", which is obtained by following the teachings of the present invention.

Similarly, it should be noted that there are many other variations in procedures, materials and the like, well known to those skilled in the art, which can have an effect on the non-rewet character of the leather. For example, long experience has shown that the type of drying technique employed has an effect on the non-rewet character, (as measured by Maeser Flexes); the highest number of flexes being generally obtained by hanging to dry; the next highest being generally obtained by vacuum drying, and the lowest number of flexes being generally obtained where the leather has been paste dried.

Similar variations can also result from contaminants and from other areas of the overall leather processing procedures. For example, in almost every system for rendering leather water resistant, it is important to minimize the wetting and degreasing agents employed in processing the leather prior to the point at which the non-rewet system is applied. Again, all of these conditions or materials which can give rise to diffferences in degree of non-rewet characteristics, are well known to those skilled in the art, and they will not generally affect the relative "improvement in kind" which can be obtained by following the teachings of the present invention.

From the foregoing results, it will be apparent that the method of the present invention will produce a treated leather having not only substantially improved water resistance, but "generally" improved characteristics, as compared to similar materials which have been treated or produced by other techniques. In addition, it would appear that the subsequent exposure of the novel leathers of the present invention to dry cleaning solvents generally tends to produce a slight additional increase in the degree of water resistance.

Most significantly, electrical conductivity tests indicate that the water barrier which is established does not interfere with the free passage of water vapor, and therefore the breathing and resulting comfort properties of the treated leather are in no way impaired.

Finally, it will be readily that while the foregoing discussion has primarily directed the results obtained in terms of increased water resistance, the teachings of the present invention have wide application in the treatment of leather not only to increase the water resistance characteristics, but also to develop other desirable characteristics, such as those related to the bound oil content and the like.

The Embodiments of the invention which an exclusive property or privilege is claimed are defined as follows:

1. In a method of treating chrome tanned leather stock which includes the step of treating said leather stock with a polymeric phosphate ester wherein said polymeric phosphate ester is a composition comprising an alkyl phenol polyphenol condensate which has been alkoxylated and phosphated, and in which A. The alkyl moiety of the alkyl phenol is selected from amongst saturated $C_6$ to $C_{18}$ alkyls which are either linear or branched chain, B. the phenol moiety of the alkyl phenol is selected from at least one of the group consisting of phenols and substituted phenols, C. the polyphenol is selected from at least one of a group consisting of polyphenols and substituted polyphenols, having from 2 to 15 benzene rings per molecule, D. the alkyl phenol and polyphenol are joined by an aldehyde, substituted aldehyde, or aldehyde liberating composition selected from at least one of the group consisting of aldehydes, substituted aldehydes, and aldehyde liberating compounds, E. the alkoxylating agent is selected from at least one of the group consisting of ethylene oxide, propylene oxide, butylene oxide and isobutylene oxide, and F. the phosphating agent is selected from at least one of a group consisting of polyphosphoric acid, phosphoric acid, phosphorous pentoxide, pyrophosphoric acid, phosphorous acid, phospholeum and phosphorous oxychloride, further characterized in that the total number of benzene rings contained in one molecule of the condensate is between 3 and 16 wherein said solvent treatment procedure comprises immersing said leather stock in a solvent selected from the group consisting of chloroform, perchlorethylene, n-Hexane, Ethyl alcohol, Ethylether, Acetone, Methyl ethyl ketone, Stoddard Solvent, Petroleum ether.

2. The method according to claim 1 wherein said treated leather has also been previously treated with a non-rewet fatliquor.

3. The method according to claim 2 wherein said non-rewet fatliquor contains an amine neutralized fatty alcohol phosphate.

4. The method according to claim 3 in which the aldehyde, substituted aldehyde or aldehyde liberating composition is selected from at least one of the group consisting of formaldehyde, paraformaldehyde, trioxane, hexamethylene tetramine, formalin, acetaldehyde, propanaldehyde, and butyraldehyde and the phosphating agent is selected from at least one of the group consisting of polyphosphoric acid, phosphoric acid and phosphorous pentoxide.

5. A method according to claim 3 wherein said composition is one in which the phosphating agent is reacted with the alkoxylated alkylphenol-polyphenol condensate in the ratio of about 0.25 to about 4 moles of phosphating agent per hydroxy moiety of the alkoxylated condensate.

6. The non-rewet leather produced by the method of claim 1.

7. The non-rewet leather produced by the method of claim 3.

8. The method according to claim 3 wherein said solvent treatment procedure comprises immersing said leather stock in an equal weight of said solvent.

* * * * *